US010006679B2

(12) United States Patent
Girmscheid et al.

(10) Patent No.: US 10,006,679 B2
(45) Date of Patent: Jun. 26, 2018

(54) DEVICE FOR A HEAT EXCHANGER FOR COLLECTING AND DISTRIBUTING A HEAT TRANSFER FLUID

(71) Applicant: Hanon Systems, Daejeon (KR)

(72) Inventors: Felix Girmscheid, Cologne (DE); Jiri Dobner, Zadverice (CZ); Lukas Ruzicka, Zlin (CZ); Ales Horak, Zlin-Malenovice (CZ); Stanislav Kren, Hluk (CZ); Jun Young Song, Daejeon (KR); Hong-Young Lim, Daejeon (KR); Peter Friesen, Merzenich (DE)

(73) Assignee: HANON SYSTEMS, Daejeon (KR)

( * ) Notice: Subject to any disclaimer, the term of this patent is extended or adjusted under 35 U.S.C. 154(b) by 0 days. days.

(21) Appl. No.: 15/073,737

(22) Filed: Mar. 18, 2016

(65) Prior Publication Data

US 2016/0282062 A1 Sep. 29, 2016

(30) Foreign Application Priority Data

Mar. 20, 2015 (DE) ..... 10 2015 104 180

(51) Int. Cl.

| | |
|---|---|
| ***F28F 9/02*** | (2006.01) |
| ***F25B 39/00*** | (2006.01) |
| ***F25B 9/00*** | (2006.01) |
| ***F28F 1/02*** | (2006.01) |
| ***F25B 39/04*** | (2006.01) |

(Continued)

(52) U.S. Cl.

CPC ..... *F25B 39/00* (2013.01); *F25B 9/008* (2013.01); *F25B 39/04* (2013.01); *F28D 1/05383* (2013.01); *F28F 1/022* (2013.01); *F28F 1/025* (2013.01); *F28F 9/0243* (2013.01); *F28F 9/182* (2013.01); *F28F 2275/045* (2013.01); *F28F 2280/00* (2013.01)

(58) Field of Classification Search

CPC ..... F28F 9/0243; F28F 1/025; F28F 2280/00; F28F 2275/045; F28F 9/182; F28D 1/05383

USPC ..... 165/173

See application file for complete search history.

(56) References Cited

U.S. PATENT DOCUMENTS

| | | | | |
|---|---|---|---|---|
| 5,743,329 A * | 4/1998 | Damsohn | F28D 1/05383 | 165/153 |
| 2012/0031601 A1* | 2/2012 | Matter, III | F28D 1/05383 | 165/177 |
| 2013/0081795 A1* | 4/2013 | Janezich | F28F 9/0221 | 165/173 |

FOREIGN PATENT DOCUMENTS

| | | |
|---|---|---|
| DE | 9321403 U1 | 11/1997 |
| JP | 2001280884 A | 10/2001 |
| KR | 20070096310 A | 10/2007 |

* cited by examiner

*Primary Examiner* — Len Tran
*Assistant Examiner* — Paul Alvare
(74) *Attorney, Agent, or Firm* — Shumaker, Loop & Kendrick, LLP; James D. Miller

(57) ABSTRACT

A device for a heat exchanger has a hollow cylindrical header and a plurality of flat tubes. A wall of the header includes a plurality of through openings. The flat tubes are received in the through openings through the wall into the inner cross-section of the header tube, and are aligned with the width of the flat tubes parallel to the direction of the inner dimension. A width of the flat tubes is greater than an inner dimension of the inner cross-section and is smaller than the outer dimension of the header tube, wherein the through openings are embodied as having grooves that continue in the wall of the header tube into the inner cross-section. The (Continued)

flat tubes, which are guided in the through openings through the wall, are arranged in the grooves.

6 Claims, 2 Drawing Sheets

(51) Int. Cl.
*F28D 1/053* (2006.01)
*F28F 9/18* (2006.01)

DEVICE FOR A HEAT EXCHANGER FOR COLLECTING AND DISTRIBUTING A HEAT TRANSFER FLUID

CROSS-REFERENCES TO RELATED APPLICATIONS

This application claims priority to German Patent Application No. 10 2015 104180.4 filed on Mar. 20, 2015, the disclosure of which is incorporated herein by reference in its entirety.

FIELD OF THE INVENTION

The invention relates to a device for a heat exchanger for collecting and distributing a heat exchange fluid, in particular a refrigerant.

BACKGROUND

Heat exchangers that are known from the prior art, in particular heat exchangers embodied as condensers in refrigeration circuits and air conditioning systems that use R134a as the refrigerant, are designed, based on the operating pressures and requirements of the systems, for burst pressures of 60 bar.

These heat exchangers have flow channels for the refrigerant that are designed as flat tubes through which the refrigerant flows in one or more rows in a single-flow or multi-flow configuration. The ends of each of the flat tubes lead to a header tube provided for more than one flat tube combined. The header tube thus serves to collect the refrigerant flowing through the individual flat tubes or to distribute the refrigerant to the individual flat tubes. Inside the header tube, the mass flow of refrigerant is redirected. Traditionally, particularly in air-refrigerant heat exchangers, fins are arranged between adjacent flat tubes.

The header tubes of the heat exchangers are embodied as integral or as having two parts. The flat tubes are arranged extending through openings in the wall, through the wall and into the interior of the header tube. Thus the inner volume of the header tube is connected to the inner volumes of the flat tubes.

A header tube for a heat exchanger, in particular for a condenser of a refrigeration circuit, is disclosed in DE 93 21 403 U1. A header tube, provided as a manifold or connecting tube, is embodied as having a plurality of slot-shaped openings arranged in its lateral surface. The openings extend with a longitudinal axis transversely to a longitudinal axis of the header tube. Some of the plurality of openings are intended to receive heat exchange tubes, while the remaining openings are designed to receive partitions.

To produce such header tubes, punches that penetrate radially into the header tube are provided, which produce the openings as they penetrate the tube. The heat exchange tubes, which are embodied particularly as flat tubes, are then inserted with one end into the openings and soldered to the header tube forming a seal.

With known prior art header tubes for heat exchangers, the slot-type openings for the flat tubes are punched or milled into the free cross-section of the tube.

FIGS. 1*a* and 1*b* each show a prior art device 1' for a heat exchanger for collecting and distributing a heat exchange fluid, having a header tube 2 embodied as integral and a plurality of flat tubes 6. FIG. 1*a* shows a sectional illustration from a plan view in the direction of the longitudinal axis of the header tube 2. FIG. 1*b* shows a perspective view.

The flat tubes 6 have inner flow channels 7 arranged parallel to one another and aligned along a longitudinal axis of the flat tubes 6, which channels are charged with fluid simultaneously when the heat exchanger is in operation.

The header tube 2, which serves as distributor or collector for the heat exchange fluid, is embodied as having through openings 5 arranged in a wall 3, also referred to as the lateral surface of the hollow cylindrical header tube 2. Through openings 5 are aligned with a longitudinal extension perpendicular to the longitudinal axis of header tube 2, and are designed to receive the flat tubes 6. A cross-sectional shape of through openings 5 is substantially the same as an outer circumferential shape of flat tubes 6, and the through openings 5 are designed as having only a tolerance with respect to the circumferential shape of the flat tubes 6 that is necessary for assembly. Circumferential shape in this case is understood as a profile perpendicular to the longitudinal axis of the flat tubes 6.

When the device 1' is in an assembled and soldered state, ends of the flat tubes 6 are arranged in the through the openings 5 in such a way that inner volumes of the flow channels 7 and an inner volume of the header tube 2 are interconnected. The inner volume of the header tube 2 is delimited by the wall 3, which also defines an inner cross-section 4 of the header tube 2, also referred to as the free cross-section 4. The ends of the flat tubes 6 project into the free cross-section 4.

The flat tubes 6, which are embodied as having a narrow side and a wide side, have a width b' across the wide side. The flow channels 7 are arranged side by side in the direction of the wide side.

The header tube 2 is embodied as a hollow cylinder according to FIGS. 1*a* and 1*b*, and has a circular free cross-section 4, enclosed by the circular wall 3 having a wall thickness s'. The free cross-section 4 is defined by an inner diameter d'. An outer diameter D' of the header tube 2 is the sum of the inner diameter d' plus twice the wall thickness s'.

When the device 1' is in the assembled state, the flat tubes 6 are aligned perpendicular to the longitudinal axis of the header tube 2 with their wide sides parallel to one another. The flat tubes 6, which have the width b', are therefore also parallel to the annular inner cross-section 4 of the header tube 2, which has the inner diameter d'. The inner diameter d' is known to be the greatest possible distance between two points on the circumferential line of the inner cross-section 4 and therefore the greatest dimension perpendicular to the longitudinal axis of the header tube 2.

Since the widths b' of the flat tubes 6 are smaller than the inner diameter d' of the free cross-section 4 of the header tube 2 and since the flat tubes 6 are aligned centered in relation to the longitudinal axis of the header tube 2, the through openings 5 extend only in the region of the free cross-section 4. The wall 3 of the header tube 2 is penetrated during the production of the through openings 5 in such a way that the slot-type through openings 5 for the flat tubes 6 extend from the outer side of the wall 3 up to the free cross-section 4 of the header tube 2.

The flat tubes 6, which are inserted into the through openings 5 through the wall 3 when device 1' is in the assembled state, end within the free cross-section 4, with the ends of the flat tubes 6 spaced from the wall 3 and not in contact with the wall 3 when they are sufficiently inserted.

When conventional devices l' from FIGS. 1*a* and 1*b* are used with the known combination of the header tube 2 having a wall thickness s' of 1 mm, for example, and the connection thereof to the flat tubes 6 having a width b' ranging from 10.0 mm to 16.0 mm, for example, for applications involving carbon dioxide as refrigerant, and thus with substantially higher pressures, an adjustment of the configuration to the necessary burst pressure of 340 bar at 160° C. would result in substantially greater wall thicknesses s' and outer diameters D'. With a width b' of the flat tube 6 of 12.0 mm and a resulting wall thickness s' ranging from 3.0 mm to 4.0 mm, the header tube 2 would have an outer diameter D' ranging from 20.0 mm to 22.0 mm. The costs and the weight of the heat exchanger would increase significantly. The amount of space required for the heat exchanger would also increase substantially.

The flat tube 6 is also embodied as having a solder dam 11' in the form of a notch or groove. The solder dam 11' is formed on the surface of the flat tube outside of the wall 3 of the header tube 2, and is aligned perpendicular to the longitudinal axis of the flat tube 6. During the soldering process, the solder dam 11' prevents liquid solder from flowing away from the wall 3 along the surface of the flat tube 6, or in the case of air-refrigerant heat exchangers, for example, in the direction of air plates or fins formed on the surface.

SUMMARY

The object of the invention is to provide a device for a heat exchanger for collecting and distributing a heat exchange fluid, which is also configured for use with carbon dioxide at very high burst pressures. The device should also have low space requirements and a minimal weight with minimal materials use, and should require only minimal production costs. Production of the device should be simple and reliable.

The object is attained by the subject matter having the features of the independent claim. Enhancements are specified in the dependent claims.

The object is attained by a device according to the invention for a heat exchanger for collecting and distributing a heat exchange fluid, in particular a refrigerant. The device is embodied as comprising a hollow cylindrical header tube having a wall and a plurality of flat tubes. The wall has an outer dimension, encloses an inner cross-section having an inner dimension, and is embodied as having through openings. The flat tubes have a narrow side and a wide side in cross-section perpendicular to a longitudinal axis.

The through openings are aligned perpendicular to a longitudinal axis of the header tube and parallel to one another with respect to a longitudinal dimension. The shape of the cross-sectional area of the through openings corresponds to the shape of the cross-sectional area of the flat tubes, in other words, the cross-sectional area of the through openings has the outer circumferential shape of the flat tubes plus a tolerance for positioning the flat tubes in the through openings.

Each of the flat tubes is arranged with one end projecting in the through openings through the wall into the inner cross-section of the header tube, and with the wide side or the width aligned parallel to the direction of the inner dimension. The flat tube is thereby aligned with its wide side in the direction of the longitudinal extension of the through opening.

According to the concept of the invention, the width of the flat tubes is greater than the inner dimension of the inner cross-section of the header tube and smaller than the outer dimension of the header tube, so that the through openings are embodied as having grooves that continue in the wall of the header tube into the inner cross-section, and the flat tubes, which are guided in the through openings through the wall are arranged in the grooves.

According to the invention, the grooves, which extend from the outside in the direction of the through opening into the inner cross-section of the header tube and are formed on the inner side of the wall, end in the core material, that is, inside the wall of the header tube.

The header tube of the device is advantageously embodied as an integral single part. The heat exchanger is preferably used as a gas cooler for the high pressure refrigerant carbon dioxide, also called R744.

According to an enhancement of the invention, the flat tubes are aligned with their wide side centered in relation to the longitudinal axis of the header tube, so that the grooves have the same dimensions on both sides of the through opening. The grooves are embodied in particular as having the same depths in the wall of the header tube.

The grooves also advantageously have the same height as, the through opening. The height is the dimension of the groove in the direction of the longitudinal axis of the header tube.

According to a preferred embodiment of the invention, the grooves extend into a region of a plane that is spanned by a longitudinal axis of the header tube, parallel to an end face of the flat tubes.

With a perpendicular alignment of the flat tubes and therefore of the grooves in relation to the longitudinal axis of the header tube, the grooves advantageously extend into a region of a central plane of the header tube, beginning from the inner side of the through openings formed through the wall.

A further advantageous embodiment of the invention involves the header tube being embodied as having a circular cross-section. In this case, the width of the flat tubes is greater than the inner diameter of the wall of the header tube and smaller than the outer diameter of the header tube. According to alternative embodiments, the header tube has an oval or asymmetrical cross-section.

According to a further preferred embodiment of the invention, each of the through openings has a chamfer on the outer side of the wall of the header tube.

The chamfer, which serves for example both as a mounting aid for inserting the flat tube through the wall and as a solder barrier during the process of connecting header tube to flat tube by soldering, is advantageously formed at least on the wide sides of the flat tube, but preferably around its entire circumference.

It is advantageous for the angle of the chamfer to range from 15° to 45°.

According to a preferred embodiment of the invention, the flat tube is arranged with an end face spaced from the ends of the grooves formed in the wall, so that a formation is produced within each of the grooves between the narrow sides of the end face of the flat tube and the ends of the grooves. During the process of connecting header tube to flat tube by soldering, the additional formation generates a capillary force on the liquid solder.

According to a further enhancement of the invention, the flat tube is arranged with one end face toward the ends of the grooves formed in the wall and is formed with a chamfer on each of the narrow sides of the end face. The chamfers create an open area for receiving liquid solder during the process of connecting header tube to flat tube by soldering, and/or enlarge the area of the aforementioned formation, for example.

According to an advantageous embodiment of the invention, the flat tube has a solder dam, which is formed between an end face of the end that projects through the wall into the inner cross-section of the header tube and a region of the flat tube arranged within the wall on a surface of the flat tube.

The solder dam is preferably aligned perpendicular to a longitudinal axis of the flat tube or parallel to the end face. The solder dam is also advantageously formed at least on the wide sides of the flat tube, but preferably around its entire circumference. The solder dam particularly has the form of a notch or groove.

In summary, the device according to the invention for a heat exchanger for collecting and distributing a heat exchange fluid has various advantages over devices known from the prior art: reducing the weight, in particular the overall weight of the heat exchanger; reducing the inner volume of the header tubes and thus of the heat exchanger, thereby minimizing the volume of refrigerant; reducing the space requirement of the heat exchanger; reducing the costs of materials, processing, and producing the heat exchanger; and decreasing the production time, particularly the soldering time, due to a lower thermal mass with a configuration for very high burst pressures.

BRIEF DESCRIPTION OF THE DRAWINGS

Additional details, features and advantages of embodiments of the invention are provided in the following description of embodiment examples with reference to the accompanying set of drawings. The drawings show.

DETAILED DESCRIPTION

Figure 2A:
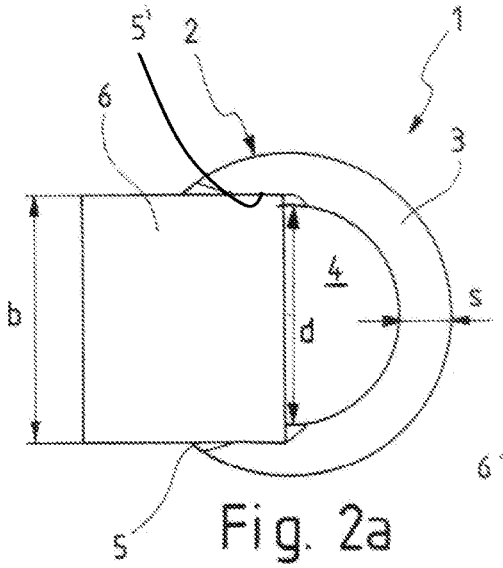
FIG. 2*a* shows a sectional illustration from a top plan view of a device for a heat exchanger for collecting and distributing a heat exchange fluid, having a header tube embodied as integral and a plurality of flat tubes.
Figure 2B:
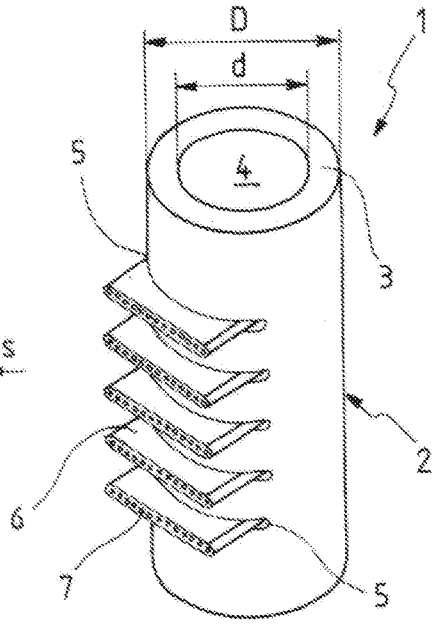
FIG. 2*b* shows a perspective view of the device for a heat exchanger of FIG. 2*a*.

FIGS. 2*a* and 2*b* each show a device 1 for a heat exchanger for collecting and distributing a heat exchange fluid, having a header tube 2 embodied as integral and a plurality of flat tubes 6. FIG. 2*a* shows a sectional illustration from a plan view along a longitudinal axis of header tube 2. FIG. 2*b* shows a perspective view.

Figure 1A:
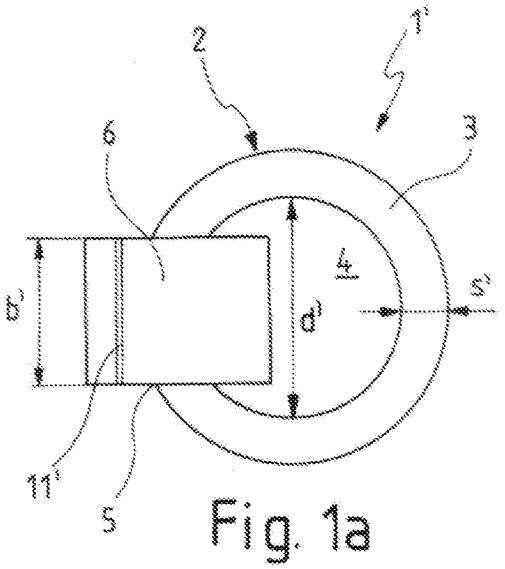
FIG. 1*a* shows a sectional illustration from a top plan view of a prior art device for a heat exchanger for collecting and distributing a heat exchange fluid.
Figure 1B:
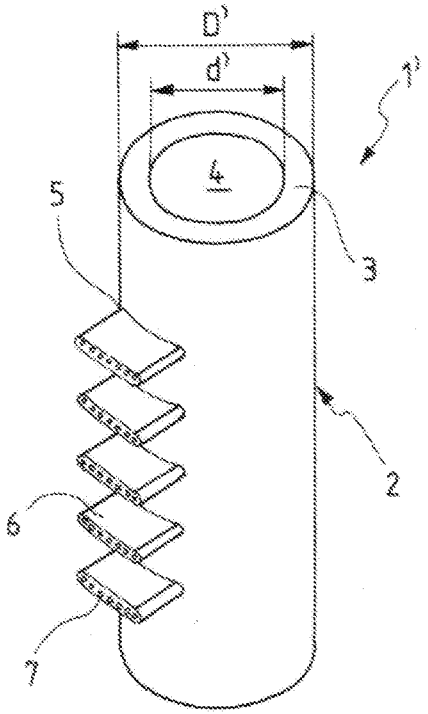
FIG. 1*b* shows a perspective view of the prior art device for a heat exchanger of FIG. 1*a*.

The same components of the device 1 are provided with the same reference signs as in FIGS. 1*a* and 1*b*.

The flat tubes 6 are likewise embodied as having inner flow channels 7 arranged parallel to one another. The inner flow channels 7 are aligned along a longitudinal axis of the flat tubes 6 and are charged with fluid simultaneously when the heat exchanger is in operation.

The hollow cylindrical header tube 2 has through openings 5 formed in a wall 3 or in the lateral surface, which are aligned with their longitudinal dimension perpendicular to the longitudinal axis of header tube 2 and which serve to receive the flat tubes 6. The cross-section or the cross-sectional area of the through openings 5, which are embodied as elongated openings, corresponds substantially to the outer circumferential shape of the flat tubes 6 plus a tolerance in terms of the circumferential shape of the flat tubes 6 that is necessary for assembly. The circumferential shape refers in this case to a section perpendicular to a longitudinal axis of the flat tubes 6.

When the device 1 is in the assembled state, the ends of the flat tubes 6 are arranged in the through openings 5. The inner volumes of the flow channels 7 of the flat tubes 7 and the inner volume of the header tube 2, which is surrounded and delimited by the wall 3, are thereby interconnected. The ends of the flat tubes 6 project into the free cross-section 4 of the header tube 2.

The flat tubes 6, which have a narrow side and a wide side, are formed as having a width b on the wide side. The header tube 2, which is embodied as a hollow cylinder according to FIGS. 2*a* and 2*b*, has a circular free cross-section 4 having an inner diameter d. The free cross-section 4 is enclosed by a circular wall 3 having a wall thickness s, so that an outer diameter D of the header tube 2 is the sum of the inner diameter d plus twice the wall thickness s.

The configuration of the circular cross-section of the header tube 2 allows refrigerant lines to be advantageously connected at any angles.

Alternatively, the cross-section of the header tube 2 can also be embodied as oval or asymmetrical.

The flat tubes 6, which are aligned with their wide sides parallel to one another, are arranged perpendicular to the longitudinal axis of the header tube 2, so that the flat tubes 6 having width b are also arranged parallel to the circular inner cross-section 4 having the inner diameter d as the greatest dimension of inner cross-section 4 perpendicular to the longitudinal axis of the header tube 2.

The flat tubes 6 have widths b which are greater than the inner diameter d of the free cross-section 4, and are smaller than outer diameter D of header tube 2. Since the flat tubes 6 are also aligned with their wide sides centered in relation to the longitudinal axis of the header tube 2, the through openings 5 project with their narrow sides at both ends beyond the free cross-section 4 and into the wall 3 of the header tube 2. The through openings 5 are thus introduced into the wall 3 of the header tube 2, in particular punched or milled, in such a way that the boundaries of the through openings 5 at the narrow sides end within the core material of the header tube 2.

Thus during the production of the elongated opening-type or slot-type through openings 5, the wall 3 of the header tube 2 is penetrated in such a way that the through openings 5 for the flat tubes 6 extend from the outer side of the wall 3 up to the free cross-section 4 of the header tube 2 and beyond, into the wall 3.

The flat tubes 6, which are inserted into the through openings 5 through the wall 3 when the device 1 is in the assembled state, are arranged up to their ends, particularly at their narrow sides, within the wall 3. The ends of the through openings 5 within the wall 3 can be used during the process of assembling device 1 as a stop for the insertion of the flat tubes 6 into the header tube 2.

As compared with the known prior art device 1' according to FIGS. 1*a* and 1*b*, which is configured for a required burst pressure of 340 bar, with a width b of the flat tubes 6 of 12.0 mm and a header tube 2 having an inner diameter d that is 1.5 mm smaller than width b of flat tubes 6, and a wall thickness s ranging from 2.0 mm to 2.5 mm, for example, the device 1 has an outer diameter ranging from 14.5 mm to 15.5 mm. In contrast, the known prior art device 1' would have to be formed with a wall thickness s' ranging from 3.0 mm to 4.0 mm and an outer diameter D' ranging from 19.0 mm to 21.0 mm.

Thus the inner diameter d of the header tube 2, which is smaller than is known from the prior art due to the arrangement of the ends of the flat tubes 6 having the narrow sides within wall 3 and therefore in the core material of the header tube 2, results in a smaller wall thickness s with the same pressure tightness.

In addition, with the decreased inner diameter d of the header tube 2, the inner volume of the heat exchanger and therefore the volume of refrigerant in the refrigeration circuit is reduced. As a result, the volume of refrigerant held in reserve or the refrigerant reservoir in the system is decreased.

Moreover, the decreased inner diameter d enables the advantageous use of a less sturdy aluminum, which in turn has an advantageous impact on the production of the device 1, in particular on the punching of the through openings 5, and therefore also on production costs.

In addition, with the narrower wall thickness s, the header tube 2 can also be produced in a single process step as a welded tube having an outer soldered coating. In comparison, it is known that header tubes that have greater wall thicknesses s' must be produced with a greater outer diameter D' and drawn to a smaller measurement in a subsequent process step.

Figure 3:
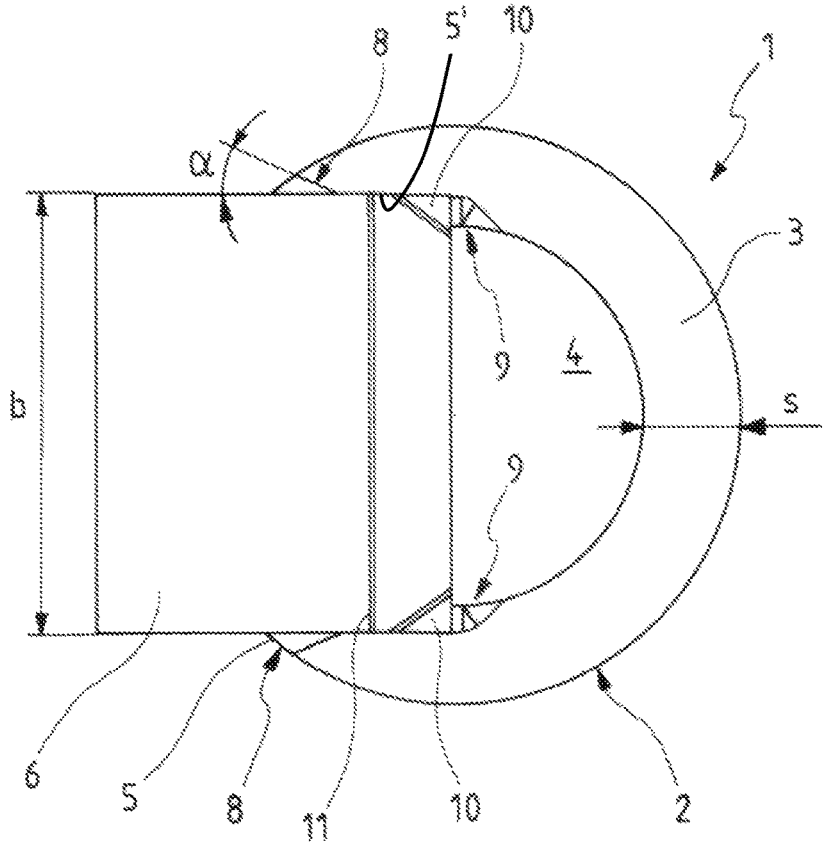
FIG. 3 shows an enlarged cross-sectional view of FIG. 2*a*.

FIG. 3 shows the device 1 for a heat exchanger for collecting and distributing a heat exchange fluid, having the header tube 2 embodied as integral and a plurality of the flat tubes 6 according to the cross-section shown in FIG. 2*a*, in an enlarged view.

The through opening 5, embodied as an elongated opening, has a chamfer 8 on the header tube 2. The chamfer 8 serves both as a mounting aid for inserting the flat tube 6 through the wall 3 and as a solder barrier during the process of connecting the header tube 2 to the flat tube 6 by soldering. The gap that is formed by the chamfer 8 between the flat tube 6 and the wall 3 of the header tube 2 generates a capillary force on the liquid solder during the soldering process, thereby preventing any blockage of the flow channels 7 of the flat tube 6.

The chamfer 8 is embodied as having an angle α ranging from 15° to 45° with respect to the longitudinal axis of the flat tube 6.

The formation of the through opening 5 extends within the wall 3, preferably up to a plane spanned by the longitudinal axis of header tube 2, parallel to an end face of the flat tubes 6, and thus not simply through the wall 3. For receiving the flat tube 6 in the wall 3, a groove 5' that continues the through opening 5 in the interior of the header tube 2 is formed, which has the same height as the through opening 5. During the assembly of the device 1, the flat tube 6 is not inserted up to the end of the groove 5' into header tube 2, so that between the end of the flat tube 6, in particular the regions of the end face, and the end of the groove 5', an open region, or a formation 9 in the form of a notch remains. The formation 9 generates additional capillary force during the soldering process, which goes beyond the end of the flat tube 6 inserted into header tube 2.

The capillary force acts on the liquid solder, thereby preventing a blockage of the flow channels 7 of the flat tube 6, since the solder is drawn into the formation 9.

To further increase the open area between the ends of the flat tube 6, in particular the areas of the end face, and the end of the groove 5', and therefore the formation 9, and thereby increase the additional capillary force, flat tube 6 is formed on the narrow sides of its end face with a chamfer 10. The region that increases, by means of the chamfer 10, the formation 9 between the end of the flat tube 6, in particular the regions of the narrow side thereof, and the end of the groove 5', generates a further added capillary force on the liquid solder during the soldering process to prevent any blockage of the flow channels 7 of the flat tube 6 and to collect liquid solder.

The flat tube 6 also has an additional solder dam 11 in the form of a notch or groove 5' having a width ranging from 0.1 mm to 0.3 mm and a depth ranging from 0.05 mm to 0.20 mm. The solder dam 11 is formed between the end face of the flat tube 6 and the region of the surface of the flat tube 6 that is located within the wall 3 when the device 1 is in the assembled state. The solder dam 11 is aligned parallel to the end face or perpendicular to the longitudinal axis of the flat tube 6 and therefore perpendicular to the direction of the flow channels 7, and extends at least on the wide sides or around an entire circumference of the flat tube 6.

During the soldering process, the solder dam 11 prevents liquid solder from flowing from the wall 3 toward the end face of the flat tube 6 and therefore likewise prevents any blockage of the flow channels 7.

LIST OF REFERENCE SIGNS

1, 1' device
2 header tube
3 wall of header tube 2
4 inner/free cross-section of header tube 2
5' groove
5 through opening
6 flat tube
7 flow channel
8 chamfer
9 formation within wall 3
10 chamfer of flat tube 6
11, 11' solder dam
D, D' outer dimension, outer diameter of header tube 2
d, d' inner dimension, inner diameter of header tube 2
b, b' width of flat tube 6
s, s' wall thickness of flat tube 6
α angle of chamfer 8

The invention claimed is:

1. A device for a heat exchanger for collecting and distributing a heat exchange fluid, comprising:

a hollow cylindrical header tube having a wall, the wall having an outer diameter and enclosing an inner cross-section having an inner diameter, the wall including a plurality of openings formed therethrough; and a plurality of flat tubes, each of the flat tubes having an end received in the inner cross-section of the header tube through one of the openings, wherein a cross-sectional shape of each of the openings corresponds to a cross-sectional shape of the each of the flat tubes, a width of each of the flat tubes is greater than the inner diameter of the inner cross-section and smaller than the outer diameter of the header tube, wherein a pair of grooves extend from each of the openings into the wall of the header tube, and wherein opposing sides of each of the flat tubes are received in the grooves, wherein each of the flat tubes has a plurality of flow channels formed therein, wherein each of the flat tubes is arranged with one end face spaced from an end of each of the grooves formed in the wall, wherein each of the flat tubes is formed with a pair of opposing narrow sides, wherein a formation is formed in each of the grooves between each of the narrow sides of the end face of each of the flat tubes and the end of each of the grooves, wherein a first chamfer is formed in the header tube adjacent each of the openings, wherein a second chamfer is formed on the end face of each of the flat tubes on each of the narrow sides and spaced from the formation, wherein each of the flat tubes has a solder dam formed on a surface of each of the flat tubes intermediate the end face and in a region of each of the flat tubes that is disposed within the wall when each of the flat tubes is assembled to the header tube, wherein a gap is formed by the first chamfer between each of the flat tubes and the wall of the header tube, and wherein the gap generates a capillary force on a liquid solder during a soldering process militating against blockage of the flow channels of each of the flat tubes.

2. The device according to claim 1, wherein each of the grooves is symmetrical.

3. The device according to claim 1, wherein a height of each of the grooves is the same as a height of each of the openings.

4. The device according to claim 1, wherein ends of the grooves extend at least up to a plane that is spanned by a longitudinal axis of the header tube and parallel to an end face of each of the flat tubes.

5. The device according to claim 1, wherein the first chamfer is formed on an outer side of the header tube.

6. The device according to claim 5, wherein the first chamfer is embodied as having an angle ranging from 15° to 45° with respect to a longitudinal axis of each of the flat tubes.

* * * * *